US007013577B2

(12) United States Patent
Kegler

(10) Patent No.: US 7,013,577 B2
(45) Date of Patent: Mar. 21, 2006

(54) SYSTEM AND METHOD FOR TESTING A FIRE SUPPRESSION SYSTEM IN A CLOTHES DRYER

(75) Inventor: Andrew F. Kegler, Ripon, WI (US)

(73) Assignee: Alliance Laundry Systems LLC, Ripon, WI (US)

( * ) Notice: Subject to any disclaimer, the term of this patent is extended or adjusted under 35 U.S.C. 154(b) by 0 days.

(21) Appl. No.: 10/867,259

(22) Filed: Jun. 14, 2004

(65) Prior Publication Data

US 2005/0023008 A1 Feb. 3, 2005

Related U.S. Application Data

(60) Provisional application No. 60/478,634, filed on Jun. 13, 2003.

(51) Int. Cl.
*F26B 19/00* (2006.01)

(52) U.S. Cl. ..... 34/89; 34/544

(58) Field of Classification Search ..... 169/61; 34/89, 88, 87, 524, 544
See application file for complete search history.

(56) References Cited

U.S. PATENT DOCUMENTS

| | | | | |
|---|---|---|---|---|
| 5,157,848 A | | 10/1992 | Dongelmans | |
| 5,272,620 A | | 12/1993 | Mock et al. | |
| 5,320,138 A | | 6/1994 | Ferlitch, Jr. | |
| 5,396,715 A | * | 3/1995 | Smith | 34/261 |
| 6,505,418 B1 | * | 1/2003 | Confoey et al. | 34/544 |
| 6,655,047 B1 | * | 12/2003 | Miller, II | 34/544 |

* cited by examiner

*Primary Examiner*—Kenneth Rinehart
(74) *Attorney, Agent, or Firm*—Leydig, Voit & Mayer, Ltd.

(57) ABSTRACT

A clothes dryer has a test button for testing the fire suppression system of the dryer. The test button is connected to the temperature sensor of the fire suppression system such that when the test button is actuated it presents a signal, such as by shorting the two leads of the temperature sensor together, to simulate the condition of the temperature sensor sensing a high temperature. This triggers the control circuit of the fire suppression system to turn on a water valve to activate the sprinkler system. The fire suppression system is then reset by actuating a reset button.

12 Claims, 5 Drawing Sheets

SYSTEM AND METHOD FOR TESTING A FIRE SUPPRESSION SYSTEM IN A CLOTHES DRYER

CROSS-REFERENCE TO RELATED PATENT APPLICATIONS

This application claims priority of U.S. provisional application Ser. No. 60/478,634, filed Jun. 13, 2003.

TECHNICAL FIELD

This invention relates generally to clothes dryers, and more particularly to a fire suppression system in a clothes dryer for suppressing fires in the drier.

BACKGROUND OF THE INVENTION

A clothes dryer typically has a rotating tumbler into which wet clothes are loaded, and heated air is passed through the tumbler to dry the clothes. Due to the high temperature of the heated air, there is a risk that the dried clothes may become overheated and develop a fire. To prevent such a risk, it is common to equip a clothes dryer with a fire suppression system. The fire suppression system typically has temperature sensors for detecting the temperature in the drying chamber that contains the tumbler, and a sprinkler or spray manifold system that is turned on when the temperature sensors detect a high temperature in the drying chamber.

To minimize the risk of fire hazard, the fire suppression system should be tested at regular intervals to ensure that it functions properly. The problem is that once the fire suppression system is installed in the clothes dryer it is difficult to test the system. Although there are several ways to test whether the fire suppression system works, such as by heating the temperature sensor above its threshold temperature or disconnecting the internal control circuit and manually short the temperature sensor, none of them is a satisfactory solution. To use a heating device on the temperature sensor inside the drying chamber would create a potential risk to the user or the equipment. Disconnecting the internal circuit could reduce the integrity of the connectors and the circuit board over time. Moreover, the relative difficulty in disconnecting the circuit and the inability to ensure that the circuit will be properly reconnected after the tests may cause the operators of the dryers to omit the testing all together. Accordingly, there is a need for way to test the fire suppression system in a clothes dryer that is easy to perform and reliable.

SUMMARY OF THE INVENTION

In view of the foregoing, the present invention provides a system for testing a fire suppression system in a clothes dryer. The fire suppression system in controlled by a control circuit, which includes a test button or switch that is connected to the temperature sensor of the fire suppression system such that when the switch is actuated it presents a signal, such as by shorting the two leads of the temperature sensor together, to simulate the condition of the temperature sensor sensing a high temperature. This triggers the control circuit of the fire suppression system to open the water valve of the sprinkler system to spray water into the drying chamber. Thus, the test button allows the fire suppression system to be tested easily, without the risk of generating a real fire by heating the temperature sensors or damaging the circuit connections. As used herein, the term "button" is intended to be interpreted broadly to be synonymous with "switch," and is not limited to any particular mechanical and electrical configuration of the switch.

The present invention also provides a method for testing a fire suppression system in a clothes dryer. The fire suppression system includes at least a temperature sensor disposed in a drying chamber containing a tumbler of the clothes dryer, and a sprinkler system disposed in the drying chamber. The fire suppression system further includes a test button that is wired such that when it is actuated it presents a signal, such as by shorting the leads of the temperature sensor together, to simulate a condition of the sensor detecting a high temperature above a pre-set threshold. To test the fire suppression system, an operator place a load, such as clothes or towels, in the tumbler and press the test button to trigger a control circuit of the fire suppression system to activate the sprinkler system, and turn the sprinkler system off after a pre-selected time period by actuating a reset button of the fire suppression system. The soaked load in the tumbler of the dryer is then taken out and its weight is measured to determine the amount of water dispensed by the sprinkler system within the pre-selected time period.

DETAILED DESCRIPTION OF THE INVENTION

Figure 1:
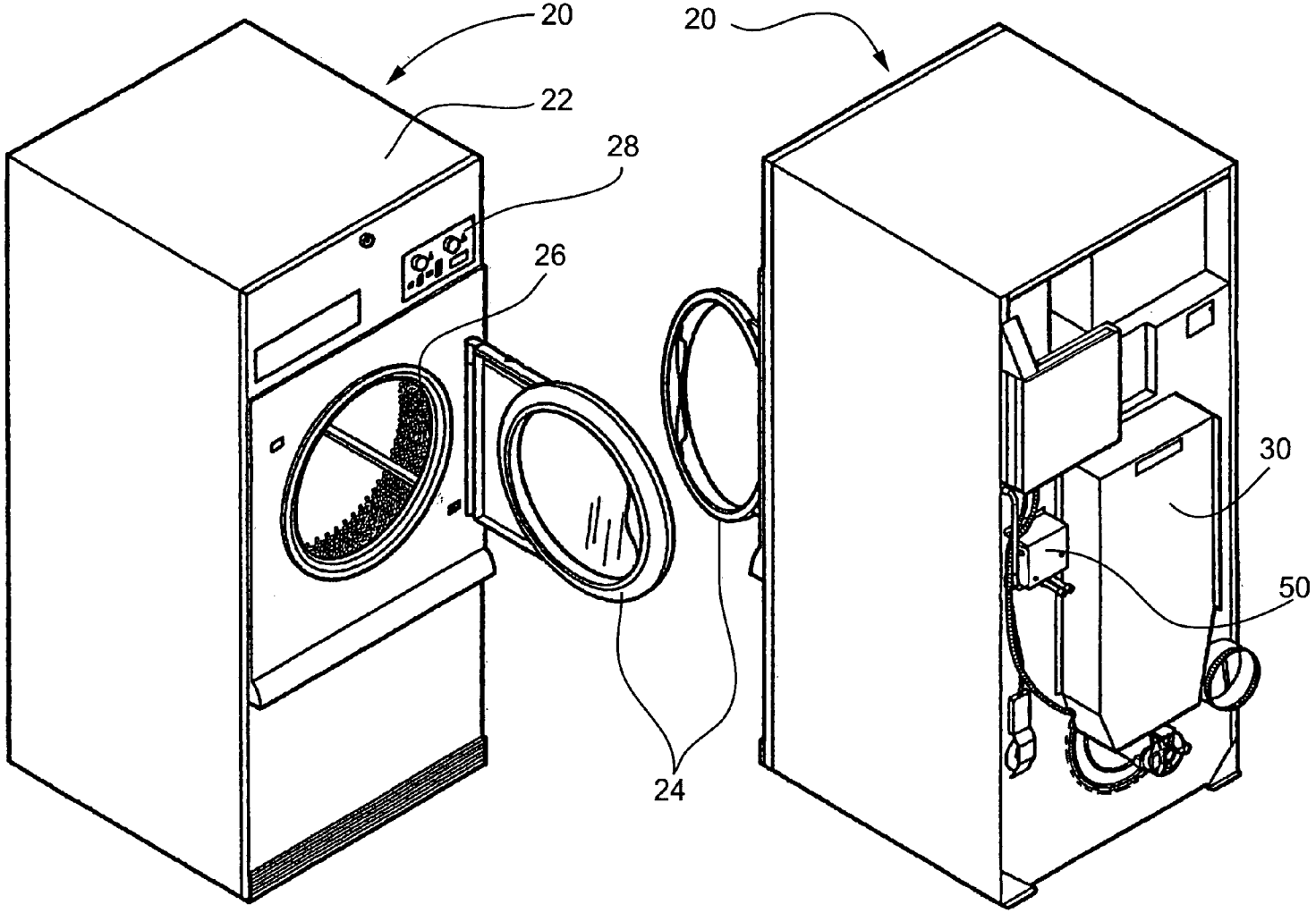
FIG. 1 is a schematic front and rear perspective view of a clothes dryer that implements an embodiment of a fire suppression system of the invention.

Turning to the drawings, wherein like reference numerals refer to like elements, FIG. 1 shows an exemplary clothes dryer 20 that implements an embodiment of a fire suppression system of the invention. The clothes dryer 20 has a housing 22, a hinged door 24 that can be opened to load wet clothes into a tumbler 26 of the dryer. The dryer 20 has a front control panel 28 that provides control knobs and buttons for an operator to control the normal functions and settings of a clothes drying operation. On the back of the dryer 20, there is a removable panel 30 that can be removed to gain access to certain mechanical and electrical components of the dryer. There is also a control box 50 for housing a control circuit for controlling the operation of the fire suppression system of the dryer. In accordance with a feature of the invention, the control circuit includes a test button for testing the functionality of the fire suppression system of the dryer, as described in detail below.

Figure 2:
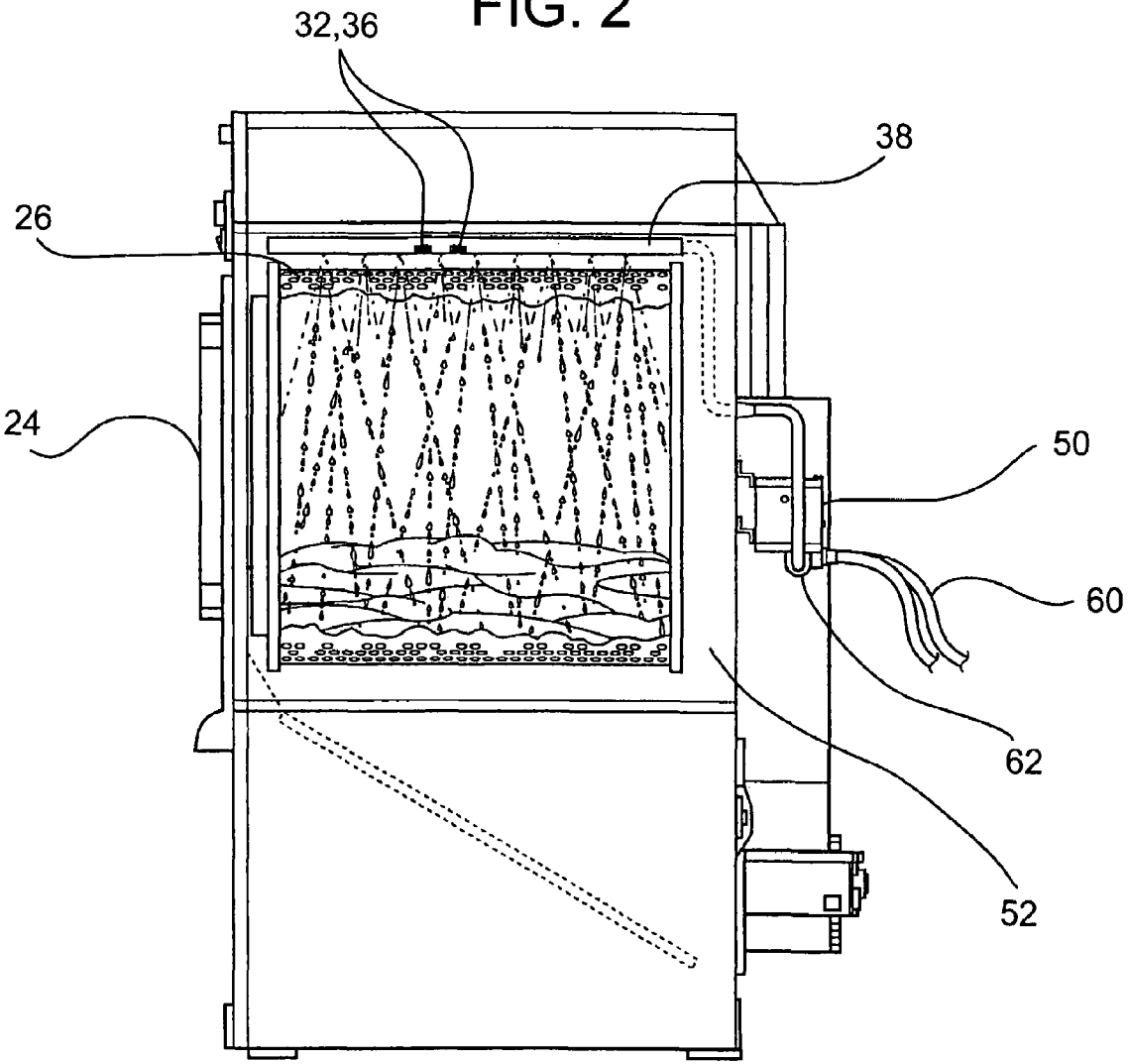
FIG. 2 is a schematic cross-sectional view of the dryer.
Figure 4:
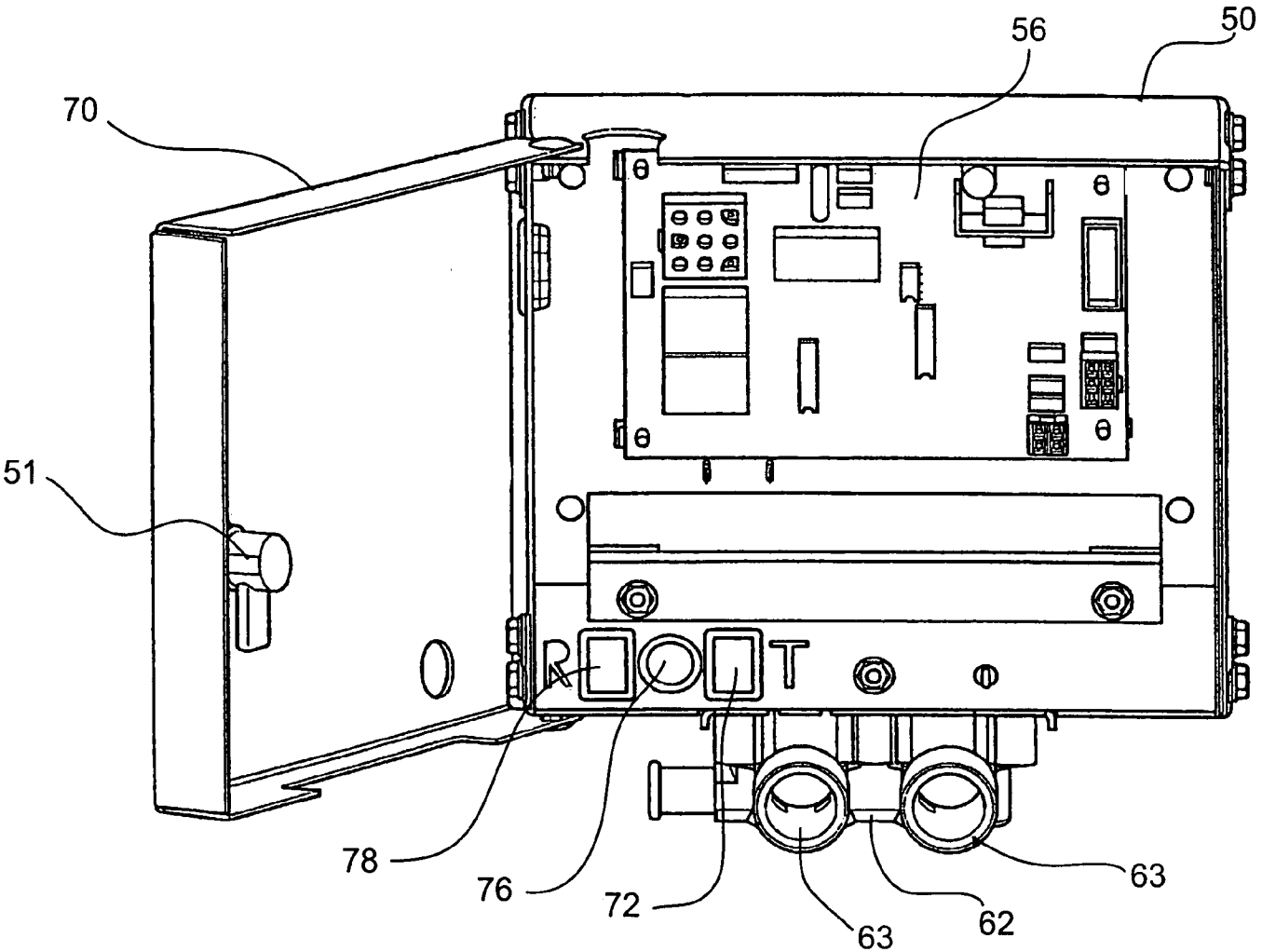
FIG. 4 is a perspective view of a control box of a fire suppression system of the clothes dryer, including a test button for testing the operation of the fire suppression system.

In an embodiment as show in FIG. 2, the dryer is equipped with a fire suppression system that includes temperature sensors 32 and 36, a sprinkler or spray manifold 38, and a control box 50 that controls the operation of the fire suppression system. The temperature sensors 32 and 36 are disposed in the drying chamber 52 of the dryer above the rotary tumbler 26 such that the temperature detected by the sensors properly correlates to the temperature in the tumbler. The sprinkler 38 is also disposed above the tumbler 26 and is activated to spray water into the drying chamber 52 if the temperature sensors detect a high temperature that exceeds a pre-selected threshold temperature, such as a pre-selected temperature in the range from 375 F to 500 F. The water is fed to the sprinkler 38 via hoses 60, and the flow is controlled by the control box 50 by means of a solenoid valve 62. As shown in FIG. 4, the hoses 60 are connected to the input connectors 63 of the valve 62.

As shown in FIG. 4, the control box 50 has a protective cover 70 that can be opened to access the control circuit 56 contained therein. To prevent unauthorized access, the cover 70 includes a lock 51 operable with a key. The control circuit 56, preferably mounted on a PCB board, controls the operation of the fire suppression system of the dryer, and includes several control features, including a Test button 72, a Lockout indication light or LED 76, and a Reset button 78, that are accessible when the cover 70 is opened.

Figure 5:
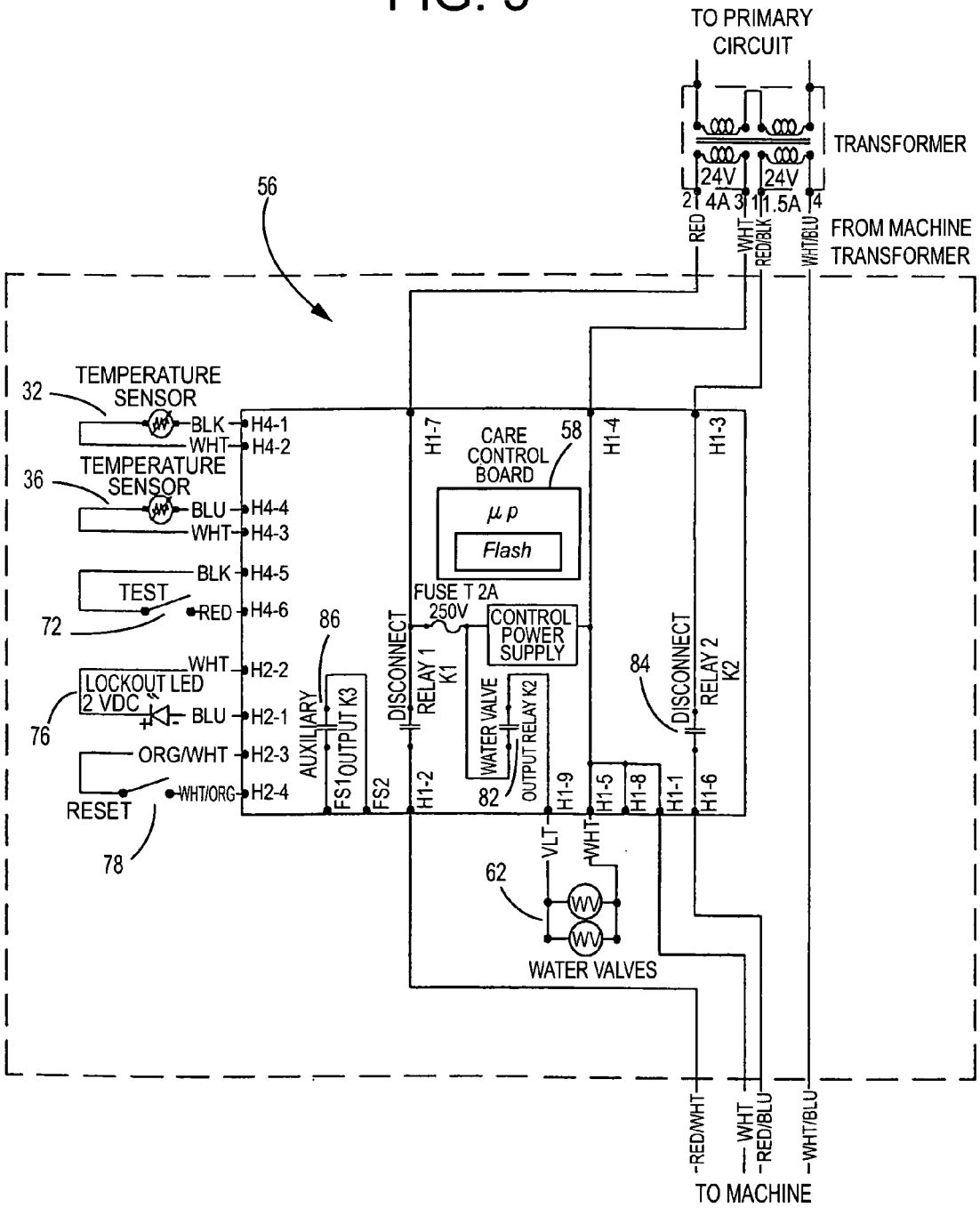
FIG. 5 is a wiring schematic for the circuitry of the control box of the fire suppression system.

Referring now to FIG. 5, to provide flexible control logic, the control circuit 56 is a microprocessor-based circuit. In one embodiment, the microprocessor 58 is a Motorola MC68HC908QY2CP 8-bit microcontroller with 1.5K bytes of flash ROM and 128K bytes of RAM. The control circuit 56 further includes three relays 82, 84, 86, for controlling the water valve 62, the electrical power for general operations of the dryer, and an auxiliary output, as described below.

Returning to FIG. 4, in accordance with a feature of the invention, the control circuit 56 provides a Test button 72 that enables easy, reliable, and safe testing of the operation of the fire suppression system of the dryer 20. The Test button 72 is wired to the temperature sensor inputs of the microprocessor 58 such that when the button is actuated it presents a signal that simulates the condition of a detection of high temperature by the sensors. This triggers the microprocessor 58 to enter a fire suppression operation, in which the sprinkler is activated to spray water into the drying chamber.

In one embodiment as shown in the wiring diagram of FIG. 5, the temperature sensors 32, 36 are thermistors. The microprocessor 58 monitors the inputs from the thermistors using two A/D input channels. The thermistor values are sampled once every second. If the A/D value for either thermistor input shows a temperature equal or higher than the trip-point temperature for five consecutive seconds, the control circuit 56 enters a Power Disconnected mode as described below. The Test button 72 is wired such that when it is actuated down to close its contact points it shorts the two leads of each of the two temperature sensors 32 and 36. This short is interpreted by the control circuit 56 to mean that the temperature sensors are detecting a high temperature that exceeds the pre-selected threshold temperature for activating the sprinkler 38. In response, the control circuit 56 opens the water valve 62. The control circuit 56 is configured such that it will keep the valve open for a pre-set interval, such as 2 minutes, and then shut the valve off and detects the temperature again. If the temperature is still too high, it opens the valve 62 to turn the sprinkler on again. This sequence may be stopped by actuating the Reset button 78, which puts the control circuit back into an idle mode if the temperature is below the threshold for activating the sprinkler.

Figure 3:
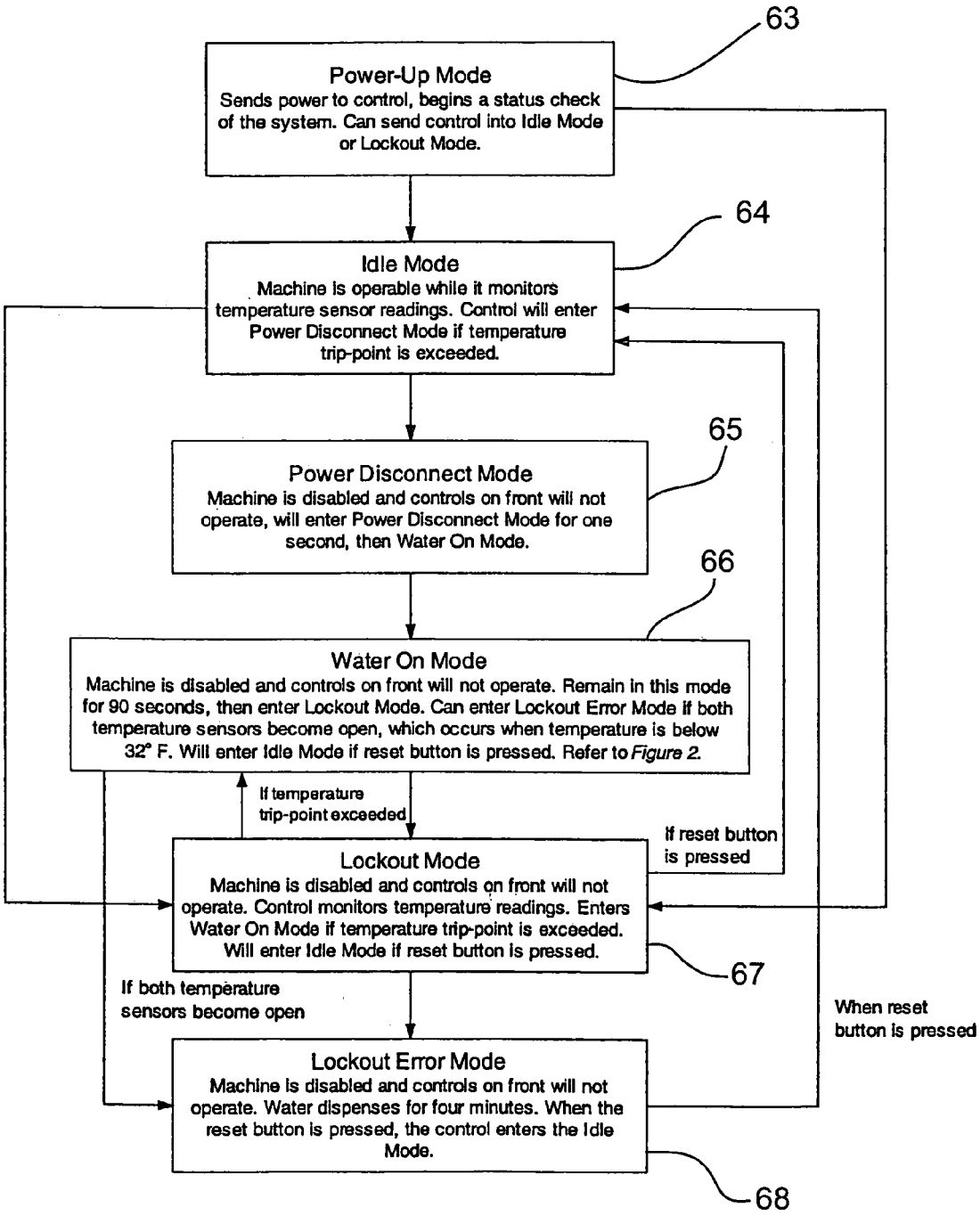
FIG. 3 is a flow diagram showing transitions between operation modes of the clothes dryer.

In one embodiment, the microprocessor 58 is programmed to have different operation modes. The program is stored in the non-volatile memory (e.g. flash memory) of the microprocessor 58. The modes of operation of the microprocessor 58 of the control circuit 56 are shown in the flow chart in FIG. 3. The control enters the Power-Up mode 63 when the dryer is powered up. The control circuit initializes all hardware by de-energizing all relays and the LED output. The microprocessor 58 examines a Status variable stored in its non-volatile memory. If this variable indicates that the control had been in the Idle mode 64 prior to power-down, it re-enters the Idle mode 64 of operation. Otherwise the microprocessor 58 enters the Lockout mode 67.

In the Idle mode 64, the microprocessor 58 de-energizes the water valve relay 82 and the auxiliary out relay 86. The power relay 84 is energized to enable the front panel control to operate, and the Lockout LED is de-energized. In this mode, the microprocessor 58 monitors the temperature sensor inputs to determine the sensed temperature in the drying chamber. If the sensed temperature has exceeded the high temperature threshold or trip-point, the control enters the Power Disconnect mode 65.

In the Power Disconnect mode 65, the auxiliary out relay 86 is energized. The power relay 84 is de-energized. As a result, the electrical power to the front control panel 28 is cut off so that the operation of the dryer is disabled, and a user will not able to operate the machine using the front panel controls. The control stays in this mode for one second and then enters the Water-On mode 66.

In the Water-On mode, the control energizes the water valve relay 82. As a result, the valve 62 is opened and the sprinkler will start spraying water into the drying chamber 52. The auxiliary output relay 86 is also energized to provide an auxiliary output signal that may be used as a warning signal to a fire department or the like. The control stays in this mode for 90 seconds, and then enters the Lockout mode 67. If bother temperature sensor inputs become open, the control enters the Lockout Error mode 68. If the Reset button 78 is actuated, the control enters the Idle mode 64.

In the Lockout mode, the control de-energizes the water valve relay 82. The control keeps the power relay 84 de-energized and the auxiliary output relay 86 energized. The control monitors the temperature sensor inputs. When the control senses that the sensed temperature has exceeded the high temperature trip-point, the control enters the Water On mode 66. If the Reset button 78 is actuated, the control enters the Idle mode 64.

In the Lockout Error mode 68, the control energizes the water valve relay 82 for four (4) minutes. The control keeps the power relay 84 de-energized and the auxiliary output relay 86 energized. The control stays in this mode until the Reset button 78 in actuated. When the Reset button 78 is actuated, the control enters the Idle mode 64.

By using the Test button 72 and the Reset button 78, an operator can quickly and easily test the performance of the fire suppression system of the dryer. The testing is preferably performed on a regular basis, such as once every three months. In an exemplary testing procedure, if the auxiliary output is connected to a separate alarm system, the operator first disconnects the auxiliary alarm output so that it will not trigger an event of false alarm. The operator removes any lint from the lint compartment of dryer. A 25-pound load of dry towels is then placed in the tumbler 26. The operator then unlocks the control box 50, and presses and holds the test button for approximately five seconds, and verifies that the light 76 is on. This will trigger the control circuit 56 to activate the fire suppression system. After a one-second pause, water should begin to spray into the drying chamber. After 15 seconds of water spray, the operator presses and holds the Reset button 78 for about one second until the water spray is off and the light 76 is off. The operator then immediately removes the water-soaked load and weighs it.

If the weight is less than a pre-determined lower limit, such as 33 pounds, the fire suppression system is deemed to have failed the maintenance test.

In view of the many possible embodiments to which the principles of the present invention may be applied, it should be recognized that the embodiments described herein with respect to the drawing figures are meant to be illustrative only and should not be taken as limiting the scope of the invention. For example, those of skill in the art will recognize that the illustrated embodiments can be modified in arrangement and detail without departing from the spirit of the invention. Therefore, the invention as described herein contemplates all such embodiments as may come within the scope of the following claims and equivalents thereof.

What is claimed is:

1. A clothes dryer comprising:

a drying chamber;

a sprinkler disposed in a drying chamber of the clothes dryer and connected to a water valve;

at least one temperature sensor disposed in the drying chamber; and a control circuit for the fire suppression system, the control circuit including a test button and a reset button, the test button being wired to the temperature sensor such that actuating the test button presents a signal to the control circuit simulating a condition of the temperature sensor reading a temperature above a pre-selected threshold to trigger the control circuit to open a water valve connected to the sprinkler to activate the sprinkler.

2. A clothes dryer as in claim 1, wherein the control circuit further includes a reset button being connected such that actuating the reset button causes the control circuit to close the water valve.

3. A clothes dryer as in claim 1, further including a tumbler disposed in the drying chamber, wherein the temperature sensor is disposed in the drying chamber above the tumbler.

4. A clothes dryer as in claim 1, wherein the control circuit includes a water valve relay for controlling the water valve, said water valve relay being opened by the control circuit in response to the condition of the temperature sensor reading a temperature above a pre-selected threshold.

5. A clothes dryer as in claim 4, further including a power relay for controlling electrical power for drying operations of the dryer; said power relay being opened by the control circuit in response to the condition of the temperature sensor reading a temperature above a pre-selected threshold.

6. A clothes dryer as in claim 5, further including an auxiliary output and an auxiliary output relay, said auxiliary output relay being closed by the control circuit in response to the condition of the temperature sensor reading a temperature above a pre-selected threshold.

7. A clothes dryer as in claim 1, wherein the temperature sensor is a thermistor, and wherein the test button is wired to short leads of the thermistor when the test button is actuated to simulate to the condition of the temperature sensor reading a temperature above a pre-selected threshold.

8. A clothes dryer as in claim 1, wherein the control circuit includes a microprocessor.

9. A clothes dryer as in claim 1, wherein the control circuit is housed in a control box mounted on a back side of the clothes dryer.

10. A clothes dryer as in claim 1, wherein the control circuit further includes an indicator light.

11. A method of testing a fire suppression system in a clothes dryer, comprising:

actuating a test button of a control circuit of the fire suppression system, the test button being wired to a temperature sensor disposed in a drying chamber of the clothes dryer such that actuating the test button presents a signal to the control circuit simulating a condition of the temperature sensor reading a temperature above a pre-selected threshold to trigger the control circuit to open a water valve connected to a sprinkler disposed in the drying chamber to spray water into the drying chamber; and after a pre-selected time interval, actuating a reset button of the control circuit to cause the control circuit to close the water valve.

12. A method as in claim 11, further including steps of:

inserting a load into the drying chamber of the clothes dryer prior to actuating the test button;

after actuating the reset button, removing the load from the drying chamber and measuring a weight of the load.

* * * * *